US009291386B2

(12) United States Patent
Kim et al.

(10) Patent No.: US 9,291,386 B2
(45) Date of Patent: Mar. 22, 2016

(54) REFRIGERATOR

(75) Inventors: Jonggon Kim, Gyeongnam (KR); Chunhee Hong, Gyeongnam (KR)

(73) Assignee: LG ELECTRONICS INC., Seoul (KR)

( * ) Notice: Subject to any disclaimer, the term of this patent is extended or adjusted under 35 U.S.C. 154(b) by 836 days.

(21) Appl. No.: 13/505,621

(22) PCT Filed: Aug. 20, 2010

(86) PCT No.: PCT/KR2010/005544

§ 371 (c)(1),
(2), (4) Date: May 2, 2012

(87) PCT Pub. No.: WO2011/093567

PCT Pub. Date: Aug. 4, 2011

(65) Prior Publication Data

US 2012/0227434 A1 Sep. 13, 2012

(30) Foreign Application Priority Data

Jan. 29, 2010 (KR) ..... 10-2010-0008679

(51) Int. Cl.

| | |
|---|---|
| ***F25C 5/00*** | (2006.01) |
| ***F25D 3/02*** | (2006.01) |
| ***F25D 3/04*** | (2006.01) |
| ***F25D 23/02*** | (2006.01) |
| ***F25D 23/06*** | (2006.01) |
| ***F25D 23/12*** | (2006.01) |
| *F25D 23/04* | (2006.01) |

(52) U.S. Cl.

CPC ..... *F25D 23/126* (2013.01); *F25C 5/005* (2013.01); *F25C 2400/10* (2013.01); *F25D 23/04* (2013.01); *F25D 2400/06* (2013.01)

(58) Field of Classification Search

CPC ..... F25C 5/005; F25C 5/007; F25C 5/182; F25D 3/02; F25D 3/04; F25D 3/045; F25D 23/028; F25D 23/066; F25D 23/067

See application file for complete search history.

(56) References Cited

U.S. PATENT DOCUMENTS

| | | | | |
|---|---|---|---|---|
| 4,209,999 | A | 7/1980 | Falk et al. | |
| 6,135,173 | A * | 10/2000 | Lee et al. | 141/361 |
| 2006/0218961 | A1 | 10/2006 | Kim et al. | |
| 2007/0113578 | A1 * | 5/2007 | Wu et al. | 62/344 |
| 2007/0157638 | A1 * | 7/2007 | Wetekamp | 62/126 |
| 2008/0134707 | A1 | 6/2008 | Kim et al. | |
| 2008/0295537 | A1 | 12/2008 | An et al. | |
| 2009/0133428 | A1 * | 5/2009 | An et al. | 62/320 |
| 2009/0165494 | A1 * | 7/2009 | Muthumani et al. | 62/390 |
| 2011/0138828 | A1 * | 6/2011 | Leclear et al. | 62/137 |

FOREIGN PATENT DOCUMENTS

| | | |
|---|---|---|
| CN | 1598451 A | 3/2005 |
| CN | 1598452 A | 3/2005 |

(Continued)

*Primary Examiner* — Frantz Jules
*Assistant Examiner* — Erik Mendoza-Wilkenfel
(74) *Attorney, Agent, or Firm* — Birch, Stewart, Kolasch & Birch, LLP

(57) ABSTRACT

Embodiments relate to a refrigerator. A refrigerator according to an aspect includes: a freezing compartment; a freezing compartment door; an ice bin mounted on the rear of the freezing compartment door and storing ice; and an operating unit mounted on the rear of the freezing compartment door and operates to discharge the ice from the ice bin.

6 Claims, 7 Drawing Sheets

(56) References Cited

FOREIGN PATENT DOCUMENTS

| | | | |
|---|---|---|---|
| CN | 101319840 | A | 12/2008 |
| JP | 2005-114198 | A | 4/2005 |
| JP | 2005-331200 | A | 12/2005 |
| KR | 1998-020964 | U | 7/1998 |
| KR | 10-2005-0117536 | A | 12/2005 |
| KR | 10-2008-0106771 | A | 12/2008 |
| KR | 10-2009-0054088 | A | 5/2009 |

* cited by examiner

REFRIGERATOR

TECHNICAL FIELD

This embodiment relates to a refrigerator

BACKGROUND ART

In general, refrigerators are equipment for storing food under low temperature, using low-temperature air.

Refrigerators include a cabinet having a storage space and a door opening/closing the storage space. The storage space may include a refrigerating compartment and a freezing compartment and the storage door may include a refrigerating compartment door opening/closing the refrigerating compartment and a freezing compartment door opening/closing the freezing compartment.

Further, the refrigerator may include an ice-making assembly that makes and stores ice, using cold air. The ice-making assembly includes an ice maker that makes ice and an ice bin that stores ice removed from the ice maker. The ice maker and the ice bin may be provided any one of inside the refrigerating compartment or to the refrigerating compartment door. A dispenser may be additionally provided at the front of the refrigerator for users to conveniently take out the ice from the ice bin.

The dispenser has a depression to easily place a vessel for putting in the ice. Therefore, the front of the door of the refrigerator is depressed and users take out the ice by placing a vessel in the depression without opening the refrigerator door.

DISCLOSURE OF INVENTION

Technical Problem

Embodiments provide a refrigerator having a clean external appearance of the freezing compartment door and automatically taking out ice from an ice bin mounted on the freezing compartment door.

Solution to Problem

In one embodiment, a refrigerator includes: a freezing compartment; a freezing compartment door; an ice bin mounted on the rear of the freezing compartment door and storing ice; and an operating unit mounted on the rear of the freezing compartment door and operates to discharge the ice from the ice bin.

In another embodiment, a refrigerator includes: a freezing compartment; a freezing compartment door opening/closing the freezing compartment and having an outer case and a door liner; an ice bin mounted on the door liner and storing ice; and a dispenser mounted on the door liner to support the ice bin and having a channel through which ice discharged from the ice bin passes.

In a further embodiment, a refrigerator according to another embodiment includes: a freezing compartment; a freezing compartment door opening/closing the freezing compartment; an ice bin mounted on the rear of the freezing compartment door and storing ice; a discharging unit operating to discharge the ice from the ice bin; and a dispensing space positioned behind the freezing compartment door, under the ice bin, where a vessel for receiving ice discharged from the ice bin is disposed.

Advantageous Effects of Invention

According to the embodiments described herein, since the dispenser is mounted on the rear of the freezing compartment door to take out ice and/or water, the dispenser is not exposed to the outside of the refrigerator, when the freezing compartment door is closed to the freezing compartment.

Therefore, the front of the freezing compartment door is clean and the aesthetic appearance is improved.

Further, since it is possible to automatically take out the ice by operating the operating unit, with the freezing compartment open, convenience for users is improved.

MODE FOR THE INVENTION

Embodiments of the present invention are described hereafter in detail with reference to the accompanying drawings.

Figure 1:
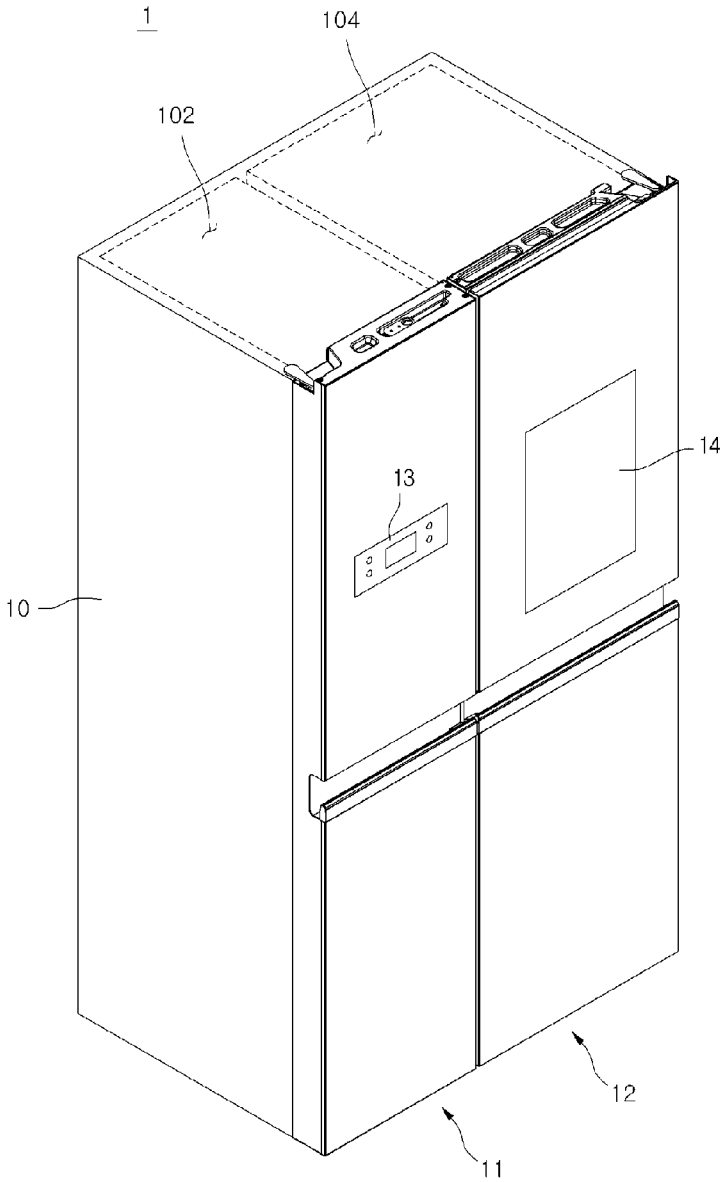
FIG. 1 is a perspective view of a refrigerator according to a first embodiment.
Figure 2:
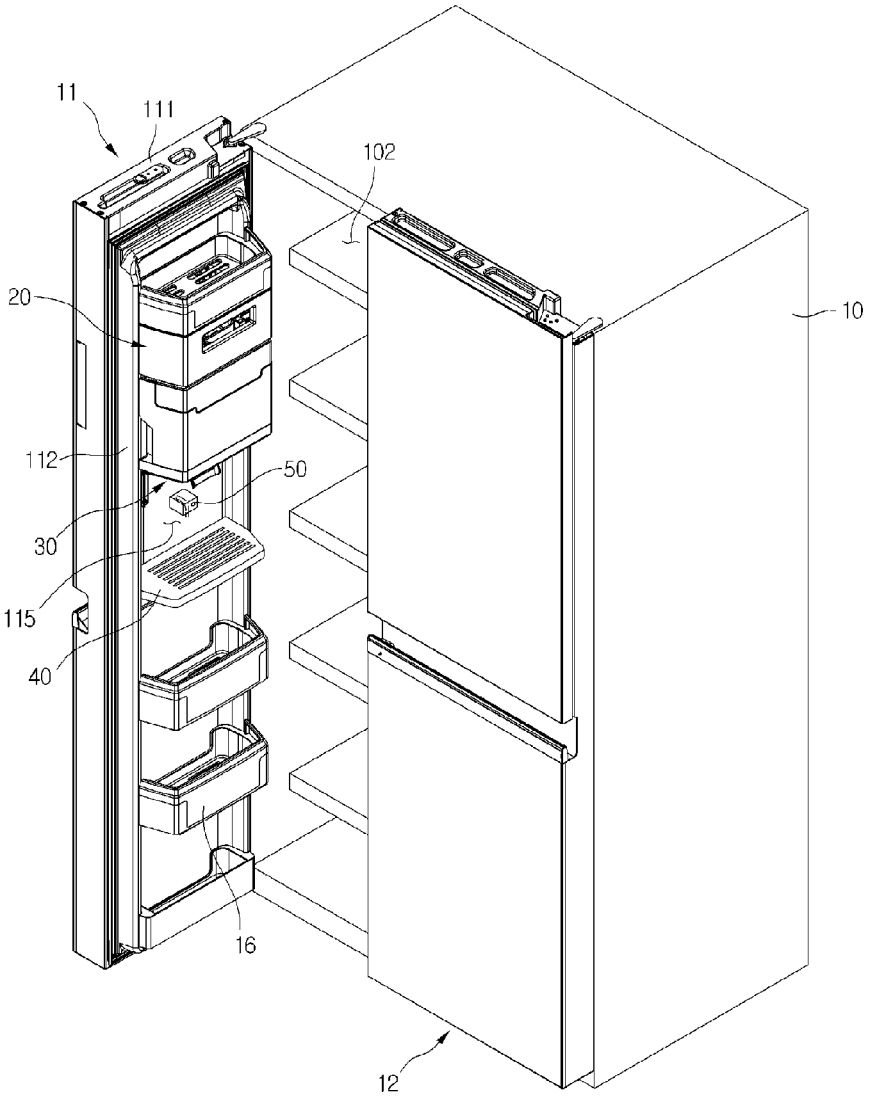
FIG. 2 is a perspective view of the refrigerator shown in FIG. 1, with the freezing compartment door open.

FIG. 1 is a perspective view of a refrigerator according to a first embodiment and FIG. 2 is a perspective view of the refrigerator shown in FIG. 1, with the freezing compartment door open.

Referring to FIGS. 1 and 2, a refrigerator 1 according to this embodiment includes a cabinet 10 having a storage space and doors 11, 12 opening/closing the storage space.

The storage space may include a freezing compartment 102 and a refrigerating compartment 104.

The freezing compartment 102 and the refrigerating compartment 104 are symmetric in the left-right direction and may be divided by a partition.

The doors 11, 12 may include a freezing compartment door 11 opening/closing the freezing compartment 102 and a refrigerating compartment door 30 opening/closing the refrigerating compartment door 104.

An input unit 13 is provided at the front of the freezing compartment door 11 to adjust temperature etc. of the freezing compartment 102 and the refrigerating compartment 104. A home bar 14 is provided at the refrigerating compartment door 12 to take out food from the refrigerating compartment 104 or take food therein, without opening the refrigerating compartment door 12.

An ice-making assembly 20 that makes and stores ice, an ice dispenser 30 that takes out the ice from the ice-making assembly 20, a water dispenser 50 that takes out water, a shelf 40, and one or more baskets 16 where food is placed, are provided on the rear of the freezing compartment door 11.

In describing this embodiment, the front of the freezing compartment door 11 implies the side (the side exposed to the outside) that is seen from the front area of the refrigerator 1, when the freezing compartment door 11 is closed to the freezing compartment 102 and the rear of the freezing compartment door 11 implies the side facing the freezing compartment 102.

The freezing compartment door 11 includes an outer case 111 and a door liner 112 connected with the outer case 111. The outer case 111 defines the front external appearance of the freezing compartment door 11 and the door liner 112 defines the rear external appearance of the freezing compartment door 11. Further, the ice-making assembly 20, the ice dispenser 30, and the shelf 40 are separably connected to the door liner 112.

The shelf 40 can support a vessel for putting water or ice therein and stores falling water. The water dispenser 50 is disposed under the ice dispenser 30 and the shelf 40 is disposed under the water dispenser 50.

Therefore, the shelf 40 is spaced apart from the water dispenser 30 in the up-down direction and a dispensing space 115 where a vessel can be placed is defined between the shelf 40 and the ice dispenser 30. That is, the dispensing space where a vessel can be placed is provided behind the rear of the freezing compartment door 11. Therefore, a user places a vessel in the dispensing space 115 and then takes out water or ice.

Since the ice dispenser 30 and the water dispenser 50 are disposed on the rear of the freezing compartment door 11 in this embodiment, the dispensers 30, 50 are not exposed to the outside of the refrigerator 1, when the freezing compartment door 11 is closed to the freezing compartment 102, as shown in FIG. 1. Therefore, the front of the freezing compartment door 11 is clean and the aesthetic appearance is improved.

Figure 3:
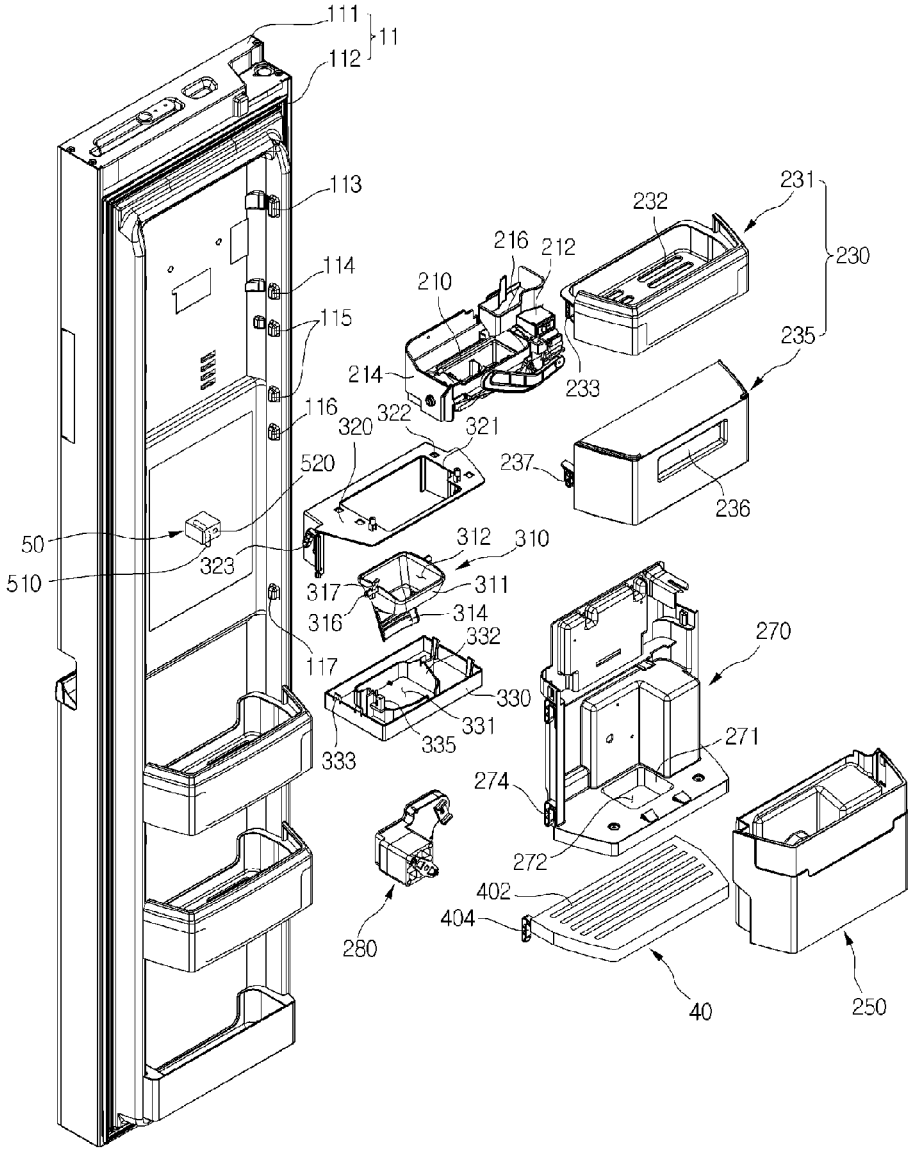
FIG. 3 is an exploded perspective view showing when an ice-making assembly according to the first embodiment is separated from the freezing compartment door.
Figure 4:
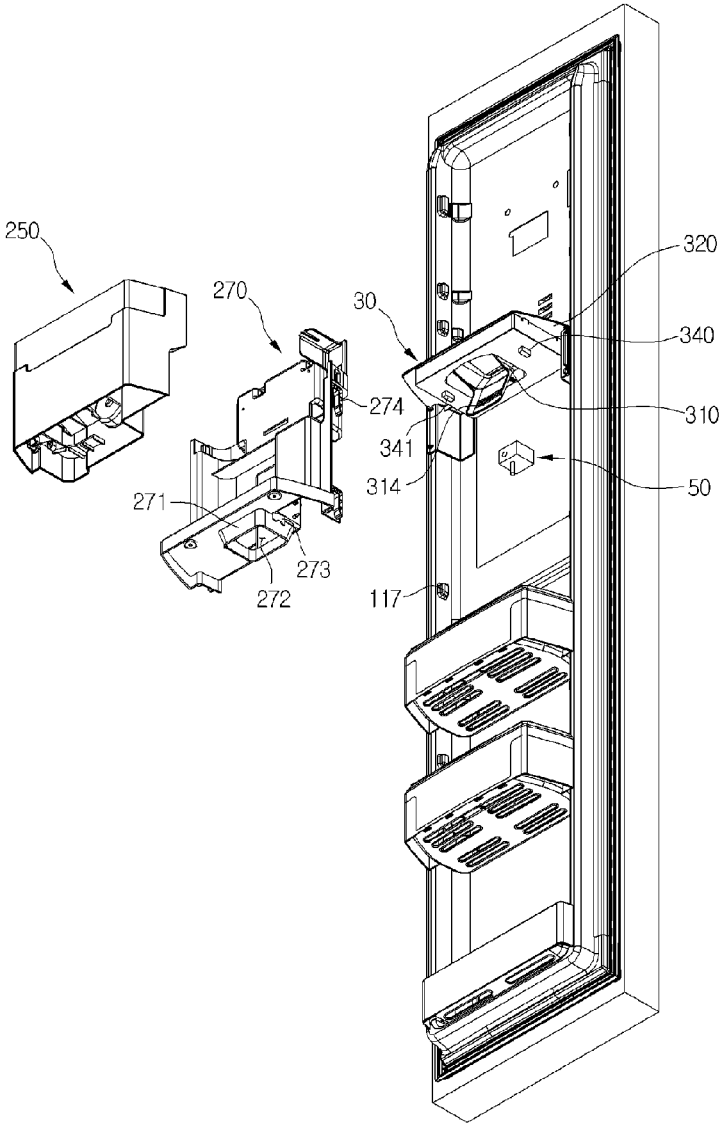
FIG. 4 is a perspective view showing the combination structure of the ice-making assembly and an ice dispenser.

FIG. 3 is an exploded perspective view showing when an ice-making assembly according to the first embodiment is separated from the freezing compartment door and FIG. 4 is a perspective view showing the combination structure of the ice-making assembly and an ice dispenser.

Referring to FIGS. 3 and 4, the ice-making assembly 20 includes: an ice maker 210 that defines a space to make ice and support the ice; a supporter 214 that rotatably supports the ice maker 210; a driving unit 212 that automatically rotates the ice maker 210 to take out the ice from the ice maker 210; and a water supply guide 216 that guides supplied water to the ice maker 210.

Further, the ice-making assembly 20 includes a cover unit that covers the ice maker 210, an ice bin 250 storing the ice taken out of the ice maker 210, a support unit 270 where the ice bin 250 and the supporter 214 are placed, and a motor assembly 280 mounted to the support unit 270 and selectively connected with the ice bin 250. The motor assembly 280 includes a motor and a power transmitting unit.

In detail, the cover unit 230 includes a first cover 231 covering the top of the ice maker 210 and a second cover 235 supporting the first cover 231 and covering the front and both sides of the ice cover 210.

The first cover 231 has one or more openings 232 through which cold air passes in the freezing compartment 102. Connecting portions 233 for combination with the door liner 112 are formed at both sides of the first cover 231.

The second cover 235 has one or more openings 236 through which cold air passes in the freezing compartment 102. Further, connecting portions 237 for combination with the door liner 112 are formed at both sides of the second cover 235. The door liner 112 has locking protrusions 113, 114 to lock the connecting portions 233, 237, respectively.

With the second cover 235 combined with the door liner 112, when the first cover 231 is combined with the door liner 112, the first cover 231 is seated on the top of the second cover 235. Food etc. can be placed on the first cover 231.

The support unit 270 supports the ice bin 250. Further, the support unit 270 is separably mounted to the door liner 112. The support unit 270 has connecting portions 274 for combination with the door liner 112 and the door liner 112 has locking protrusions 115 to lock the connection portions 274.

Therefore, with the ice maker 210 and the ice bin 250 mounted on the support unit 270, the support unit 270 is mounted to the door liner 112.

An ice duct 217 through which ice discharged from the ice bin 250 passes is formed through the bottom of the support unit 270. The ice duct 271 has an ice opening 272.

The ice dispenser 30 is separably mounted to the door liner 112 and the ice-making assembly 20, in detail, supports the support unit 270.

The ice dispenser 30 includes an operating unit 310 that is operated to take out the ice from the ice bin 250, housings 320, 330 that support and protect the operating unit 310, and a sensing unit 335 that senses the operation of the operating unit 310.

In detail, the operating unit 310 includes a body 312 providing a channel 312 for ice, a lever 314 extending downward from the body 311 and pressed by a user to take out the ice, and a shaft 316 protruding through both sides of the body 311 to function as a pivot for the body 311. The shaft 316 has an extender 317 that extends perpendicular to the longitudinal direction of the shaft 316. The extender 317 contacts the sensing unit 335, when the operating unit 310 rotates.

The housings 320, 330 includes a first housing 320 combined with the door liner 112 and a second housing 320 combined with the first housing 320 and rotatably supporting the operating unit 310.

The first housing 320 has an opening 321 through which the operating unit 310 passes. Further, the first housing 320 has one or more connecting portions 323 for combination with the door liner 112 and one or more connecting holes 322 for combination with the second housing 330. Further, the door liner 112 has connection protrusions 116 connected with the connecting portions 323.

The second housing 330 is connected to the lower portion of the first housing 320. The second housing 330 includes an opening 331 through which the operating unit 310 passes, a shaft supporter 332 supporting the shaft 316 of the operating unit 310 passing through the opening 331, and one or more hooks 333 fitted in the connecting holes 322 of the first housing 320. In this structure, a shaft cover 273 seated on the shaft 316 of the operating unit and guides the rotation of the shaft 316.

The sensing unit 335 may be mounted in the second housing 330, for example. The sensing unit 335 may be, for example, a switch. As the operating unit 310 is rotated to take out the ice, the extender 317 presses the switch and the switch is turned on. As the switch is turned on, a turning-on signal of the switch is transmitted to a control unit (not shown) and the control unit operates the motor assembly 280.

One or more light emitting elements 340, 341 that emit light to the operating unit 310 may be disposed beneath the second housing 330. For example, LEDs may be provided for the light emitting elements 340, 341 as light sources. The light emitting elements 340, 341 may be turned on, with the freezing compartment door 11 open from the freezing compartment 102.

Although the light emitting elements 340, 341 are mounted at the second housing in this embodiment, they may be mounted to the door liner 112. Alternatively, the light emitting elements may be disposed beneath the second housing and to the door liner 112.

Meanwhile, the water dispenser 50 is disposed under the water dispenser 30. The water dispenser 50 includes an operating unit 520 for taking out water and a water discharging pipe 510.

Water flowing through the water discharging pipe 510 or water supplied to the ice maker 210 may be supplied from an external water supply pipe or from a water tank mounted to the freezing compartment door 11.

When water is supplied through an external water supply pipe at the outside of the refrigerator 1, a water pipe through which the water flows extends from the main body to the inside of the freezing compartment door through a hinge of the freezing compartment door. Further, two pipes diverge from the water pipe, in which one of the diverging pipe may be connected with the water discharging pipe 510 and the other diverging pipe may extend upward from the water supply guide 216.

Meanwhile, the shelf 40 has openings 402 through which water flows inside and connecting portions 404 for combination with the door liner 112. Further, the door liner 112 has connection protrusions 117 connected with the connecting portions 404.

Figure 5:
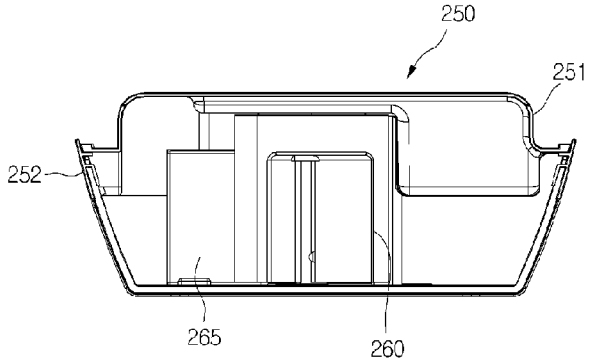
FIG. 5 is a plan view of an ice bin according to the first embodiment.
Figure 6:
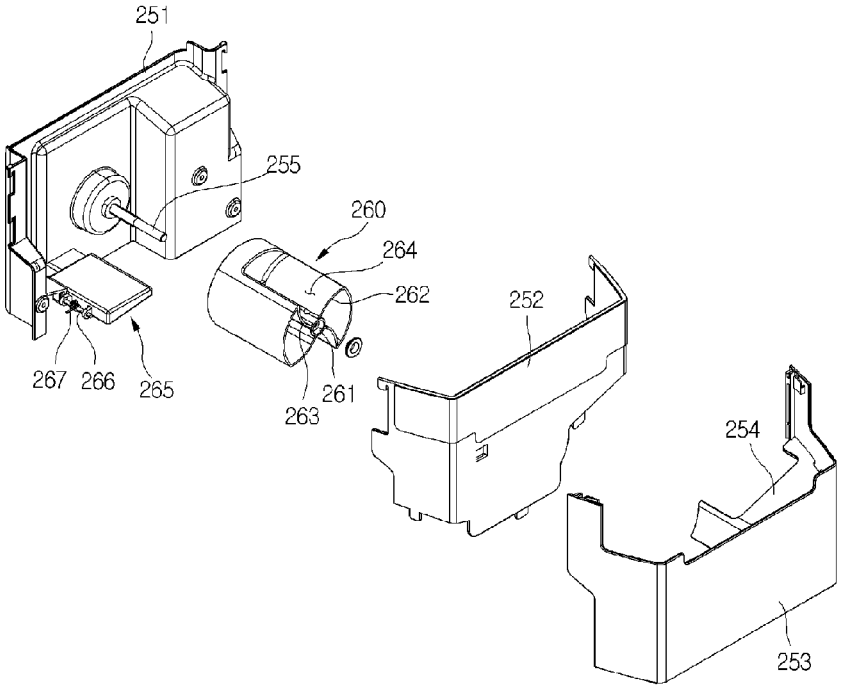
FIG. 6 is an exploded perspective view of the ice bin according to the first embodiment.

FIG. 5 is a plan view of an ice bin according to the first embodiment and FIG. 6 is an exploded perspective view of the ice bin according to the first embodiment.

Referring to FIGS. 5 and 6, the ice bin 250 according to this embodiment includes a first body 251, a second body 252 combined at the front of the first body 251, and a third body 253 combined with the first body 251 from under the second body 252. Further, the bottom of the ice bin 250 is open to discharge the ice, with the bodies 251, 252, 253 assembled. Further, the third body 253 has a guide surface 254 that guides the ice.

Further, the ice bin 250 includes a discharging unit that discharges the stored ice and a guide member 265 disposed under the discharging unit 260. The discharging unit 260 is fitted on a rotary shaft 255 mounted on the first body 251 to be rotated. The rotary shaft 255 is connected to the motor assembly 280, when the ice bin 250 is mounted on the support unit 270.

The discharging unit 260 has one or more depressed retaining portions 264 generally formed in a cylindrical shape to retain the ice. A shaft-fitting portion 261 where the rotary shaft is fitted 255 is formed through the center of the discharging unit 260.

The discharging unit 260 has a first extending portion 262 and a second extending portion 263 which extend from the shaft-fitting portion 261 to cross the shaft-fitting portion 261.

The extending portions are spaced apart from each other and rounded at the shaft-fitting portion 261. Further, the first extending portion 262 and the second extending portion 263 define the retaining portions 264.

The guide member 265 is rotatably fitted on a rotary shaft 266 formed on the first body 251. Further, the guide member 265 is elastically supported by an elastic member 267 such that the guide member 265 can return to the initial position after rotating.

When ice is positioned between the discharging unit 260 and the guide member 2655 and the discharging unit 260 rotates in one direction, the discharging unit 260 pushes the ice and the guide member 265 rotates down. Accordingly, the ice between the guide member 265 and the discharging unit 260 can fall.

Hereinafter, a process when ice made by the ice-making assembly moves is described.

Figure 7:
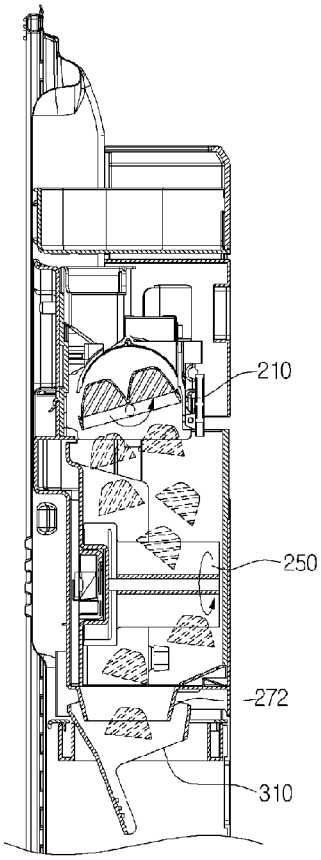
FIG. 7 is a partial cross-sectional view of the freezing compartment view according to the first embodiment.

FIG. 7 is a partial cross-sectional view of the freezing compartment view according to the first embodiment.

Referring to FIGS. 1 to 7, the driving unit 212 is operated in response to an operation signal inputted in the driving unit 212 to remove the ice from the ice maker 210. Accordingly, the power of the driving unit 212 is transmitted to the ice maker 210 and the entire ice maker 210 rotates. The ice is removed by twisting the ice maker 210 in this embodiment. Torsion is generated due to relative motion of one end and the other end of the ice maker 210 when the ice make 210 is twisted, such that the ice is removed from the ice maker 210. The principle of twisting the ice maker 210 is that same as that well known in the art and the detailed description is not provided.

The ice removed from the ice maker 210 falls into the ice bin 250 and stored in the ice bin 250.

Meanwhile, a user presses the lever 314 of the operating unit 310 to take the ice from the ice bin 250. For example, it is possible to press the lever 314 with a vessel to put the ice therein. As the lever 314 is pressed, the operating unit 310 is rotated and the extender 317 of the operating unit 310 becomes in contact with the sensing unit 335.

Accordingly, a signal is transmitted from the sensing unit 335 to the control unit and the control unit operates the motor. As the motor operates, the rotary shaft 255 rotates in one direction (counterclockwise in FIG. 6). Accordingly, the discharging unit 260 rotates in one direction, and the ice is retained in the retaining portion 264 of the discharging unit 260 while the discharging unit 260 rotates. Further, as the discharging unit 260 continuously rotates, the ice retained in the retaining portion 264 falls. The falling ice is discharged outside the freezing compartment door 11 through the ice opening 272 of the support unit 270 and the channel 312 of the operating unit 310.

Meanwhile, when the force pressing the lever 314 is removed, the extender of the operating unit 310 is separated from the sensing unit 335. Accordingly, the control unit stops the motor.

According to this embodiment described above, since it is possible to automatically take out the ice by operating the operating unit, with the freezing compartment open, convenience for users is improved.

Although this embodiment exemplifies that the ice maker of the ice-making assembly is mounted on the freezing compartment door, the ice maker may be mounted in the freezing chamber. In this case, the ice bin may be positioned right under the ice maker, when the freezing compartment door is closed to the freezing compartment.

Figure 8:
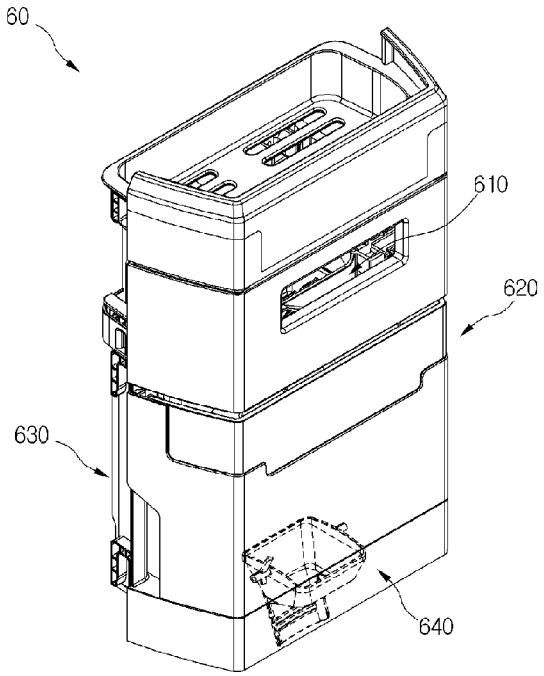
FIG. 8 is a perspective view of an ice-making assembly according to a second embodiment.

FIG. 8 is a perspective view of an ice-making assembly according to a second embodiment.

Referring to FIG. 8, an ice-making assembly 60 of this embodiment includes an ice maker 610, an ice bin 620 storing ice made by the ice maker 610, a support unit 630 supporting the ice maker 610 and the ice bin 620, and a dispenser 640 provided to the support unit 630.

That is, according to this embodiment, the ice maker 610, the ice bin 620, and the dispenser 640 are shaped in a module and separably mounted to the rear of the freezing compartment door. However, a sensing unit disposed in the dispenser 640 may be connected to a connector disposed at the freezing compartment door.

Figure 9:
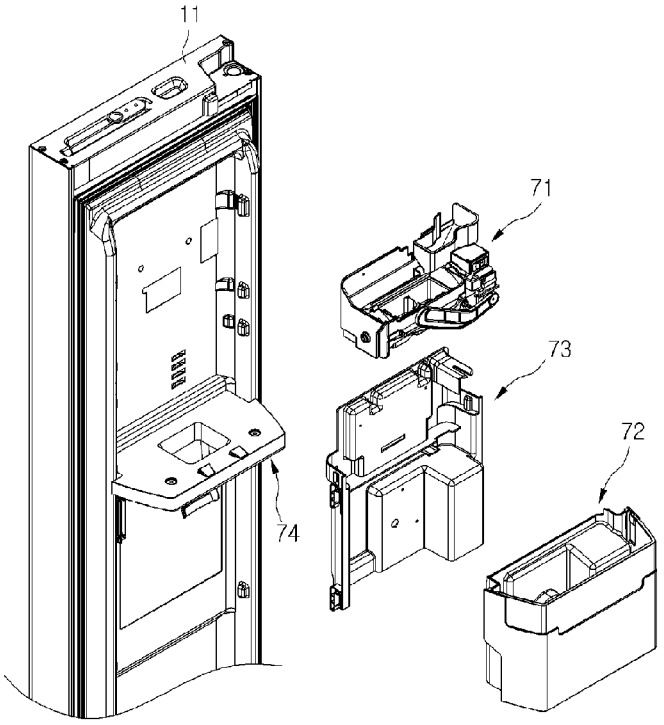
FIG. 9 is a partial exploded perspective view of a freezing compartment door according to a third embodiment of the present invention.

FIG. 9 is a partial exploded perspective view of a freezing compartment door according to a third embodiment of the present invention.

Referring to FIG. 9, an ice dispenser 74 is separably mounted to the freezing compartment door 11 and an ice bin 72 storing ice is mounted above the ice dispenser 74. An ice maker 71 is mounted on a support unit 73 and the support unit 73 is separably mounted to the freezing compartment door 11. In this configuration, with the support unit 73 mounted to the freezing compartment door 11, the support unit 73 is seated on the ice dispenser 74.

The ice bin 72 is placed on the ice dispenser 74, after the support unit 73 is mounted to the freezing compartment door 11.

Figure 10:
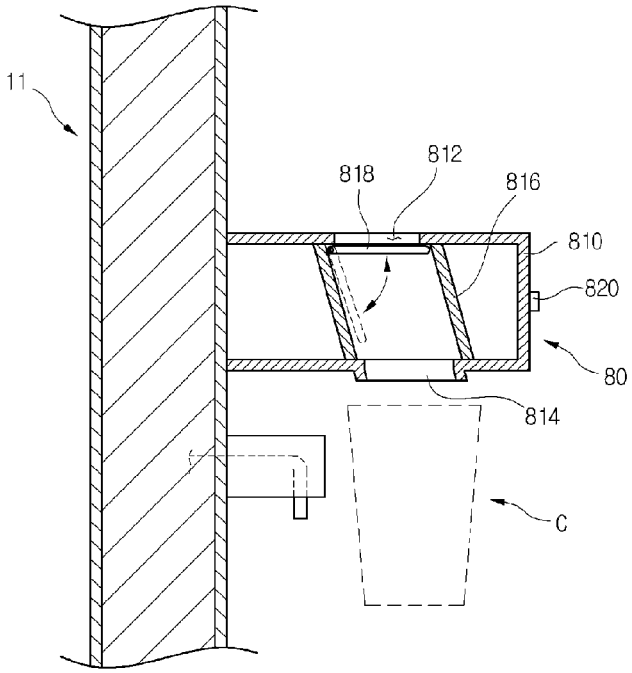
FIG. 10 is a partial cross-sectional view of the freezing compartment view according to the fourth embodiment.

FIG. 10 is a partial cross-sectional view of the freezing compartment view according to the fourth embodiment.

Referring to FIG. 10, an ice dispenser 80 mounted to a freezing compartment door 11 includes a housing 810, an ice duct 816 disposed in the housing, and an operating unit 820 provided to the housing 810.

In detail, an ice inlet 812 through which ice discharged from the ice bin is put inside is formed at the top of the housing 810 and an ice outlet 814 is formed at the bottom of the housing 810.

The ice duct 816 connects the ice inlet 812 with the ice outlet 814. That is, the ice duct 816 provides a channel for movement of the ice. The ice duct 816 has a closing member 818 to selectively connect the ice inlet 812 with the ice outlet 814. The closing member 818 is rotatably connected to the inner side of the ice duct 816 and can be rotated by a motor, which is not shown.

As a user operates the operating unit 820 to take out the ice, the closing member 818 is rotated by the motor. Accordingly, the ice inlet 812 and the ice outlet 814 are connected, such that the ice can pass through the ice duct 816. In this position, the ice inlet 812 is connected with the ice bin and the ice outlet 814 is connected to the outside, such that it can be described that the closing member 818 selectively connects the inside with the outside of the ice bin.

Since the closing member 818 operates to discharge the ice, it can be called a discharging member.

The operating unit 820 may include a button.

Figure 11:
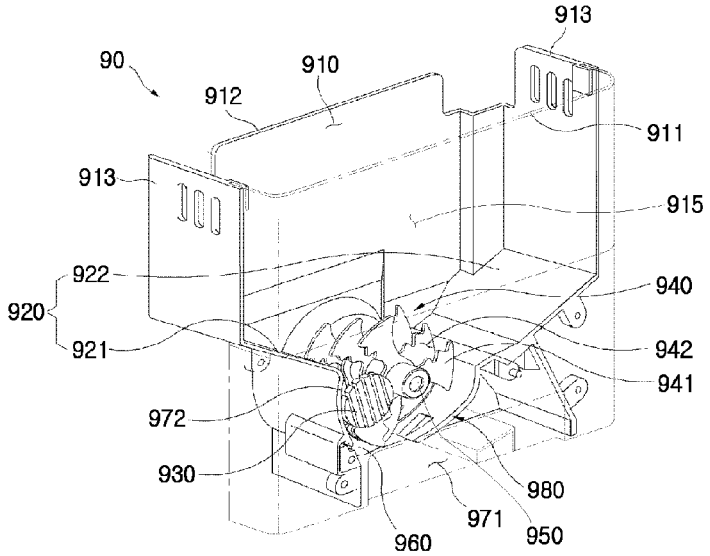
FIG. 11 is a perspective view of an ice bin according to a fifth embodiment.

FIG. 11 is a perspective view of an ice bin according to a fifth embodiment.

Referring to FIG. 11, an ice bin 90 according to this embodiment has an opening 910 at the top. The ice bin 90 has a front wall 911, a rear wall 912, and both side walls 913.

A guide slope 920 that allows the stored ice to slide downward by its own weight while supporting the ice is provided inside the ice bin 90.

An ice storage space 315 where the ice is stored is defined by the front wall 911, the rear wall 912, both walls 913, and the guide slope 920.

The guide slope 920 has a first guide slope 921 and a second guide slope 922. The first guide slope 921 declines toward the center from any one of both walls 913 and the second guide slope 922 declines toward the center from the other one of both side walls 913.

An ice discharging member 940 that discharges the ice from the ice bin 90 to the outside of the ice bin 90 is disposed between the first guide slope 921 and the second guide slope 922. That is, the first guide surface 921 and the second guide surface 922 are positioned at the left and right sides of the ice discharging member 940.

The ice discharging member 940 includes one or more rotary blades that form a pre-determined space 942 where the ice is provided. The ice discharging member 940 may include a plurality of rotary blades 941 to easily discharge the ice.

One or more fixed blades 960 are disposed inside the ice bin 940 to crush the ice in interaction with the rotary blades 941. It is preferable to dispose a plurality of fixed blades 960 inside the ice bin to crush the ice well.

An anti-ice lock 930 protruding toward the rotary blade 941 is mounted to the rear of the front wall 911 of the ice bin 90 in order to prevent the ice is stuck between the rotary blades 941 and the front wall 911 of the ice bin 90.

The rotary blades 941 and the fixed blades 960 are fitted on a rotary shaft 950. The rotary shaft 950 can be rotated in both directions by the motor assembly (not shown).

An outlet 971 for discharging the complete ice or pieces of ice is formed at the lower portion inside the ice bin 90. Further, a closing member 980 that operates when the complete ice is discharged is disposed at the opposite side to the fixed blade 960 with respect to the rotary shaft 950. The closing member 980 may be supported by an elastic member, which is not shown.

The rotary shaft 950 rotates in the first direction (e.g. counterclockwise in FIG. 11) to discharge pieces of ice from the ice bin 90. Accordingly, the ice is crushed by the interaction of the rotary blades 941 and the fixed blades 960 and the pieces of ice fall through the outlet 971.

On the contrary, the rotary shaft rotates in the second direction (clockwise in FIG. 11) to discharge the complete ice from the ice bin. Accordingly, the ice in the space 942 of the rotary blades 941 is moved to the closing member 980 by the rotation of the rotary blades 941.

As the rotary blades 941 continues rotating in the second direction, each of the rotary blades 941 presses the ice on the closing member 980. Therefore, pressing force from the rotary blades 941 is applied to the closing member 980 through the ice.

The closing member 980 is rotated down by the pressing force transmitted from the rotary blades 941 through the ice, such that the ice is discharged outside.

As described above, according to this embodiment, it is possible for a user to selectively take out complete ice or pieces of ice.

Obviously, though not shown, a selection button for selecting the types of ice may be provided in the dispenser or the front of the freezing compartment door.

In this embodiment, the rotary blades 941 operate to discharge the ice, such that it may be called a discharging unit.

The invention claimed is:

1. A refrigerator comprising:

a freezing compartment;

a freezing compartment door that opens and closes the freezing compartment, the freezing compartment door including a door liner with a plurality of dikes;

a housing mounted on the plurality of dikes;

an operating unit providing a channel for ice and mounted on the housing, the operating unit being operated to discharge the ice;

a support unit disposed at an upper side of the housing and including an ice opening communicated with the channel;

a motor assembly mounted to the support unit;

an ice bin detachably mounted to the support unit and including an ice discharging unit that discharges ice stored in the ice bin, the ice discharging unit being connected to the motor assembly; and an ice maker disposed above the ice bin and mounted to the support unit, wherein the ice in the ice bin is discharged outside the freezing compartment door through the ice opening of the support unit and the channel of the operating unit.

2. The refrigerator according to claim 1, wherein the freezing compartment door further includes:

an outer case defining the front external appearance of the freezing compartment, wherein the door liner is connected to the outer case.

3. The refrigerator according to claim 1, wherein the ice discharging unit is operated and the ice is discharged through the ice opening of the support unit and the channel of the opening unit when the operating unit is operated.

4. The refrigerator according to claim 3, wherein the ice discharging unit selectively communicates an inside of the ice bin with an outside of the ice bin.

5. The refrigerator according to claim 1, wherein the operating unit includes a body having the channel communicated with the ice bin and a lever extended from a bottom of the body.

6. The refrigerator according to claim 1, further comprising a water dispenser disposed at the rear of the freezing compartment door, under the operating unit, to take out water.

* * * * *